US005960758A

United States Patent [19]

Giannone et al.

[11] Patent Number: 5,960,758

[45] Date of Patent: Oct. 5, 1999

[54] ROLLER CAM FOLLOWER BEARING SHAFT RETENTION

[75] Inventors: Guy Ernest Giannone, Bergen; Gary Donnell Blake, Rochester, both of N.Y.

[73] Assignee: General Motors Corporation, Detroit, Mich.

[21] Appl. No.: 09/072,856

[22] Filed: May 5, 1998

[51] Int. Cl.[6] ..... F01L 1/14; F01L 1/18

[52] U.S. Cl. ..... 123/90.42; 123/90.5

[58] Field of Search ..... 123/90.39, 90.41, 123/90.42, 90.44, 90.48, 90.5, 90.52, 90.55

[56] References Cited

U.S. PATENT DOCUMENTS 3,108,580 10/1963 Crane, Jr. ..... 123/90.5
5,385,124 1/1995 Hillebrand et al. ..... 123/90.5
5,606,939 3/1997 Spath ..... 123/90.5
5,775,275 7/1998 Philo ..... 123/90.5

*Primary Examiner*—Weilun Lo
*Attorney, Agent, or Firm*—Karl F. Barr; Vincent A. Cichosz

[57] ABSTRACT

A roller cam follower has a transverse bearing shaft that is restrained against substantial lateral motion in a follower body supporting the shaft which rotatably carries a cam follower roller. The follower roller is rotatably mounted in a recess between opposite sides of the body on the transverse bearing shaft, which is supported in shaft bores through the sides of the body. One or more retainers are pressed onto the shaft within the recess and are operatively engageable with the sides of the body to limit axial motion of the shaft in said shaft bores. Various embodiments of retainers are disclosed as are applications to various types of roller cam followers, such as valve lifters, finger followers and rocker arms.

13 Claims, 2 Drawing Sheets

ROLLER CAM FOLLOWER BEARING SHAFT RETENTION

TECHNICAL FIELD

This invention relates to roller cam followers for engines including, for example, roller rocker arms, roller finger followers and roller valve lifters for engines including hydraulic valve lifters. In particular, the invention relates to means and methods for retaining a roller bearing shaft against axial movement in a follower body.

BACKGROUND OF THE INVENTION

It is known in the art relating to roller cam followers, such as roller hydraulic valve lifters and finger followers to provide a steel roller bearing shaft supporting a cam follower roller and retained in laterally spaced shaft bores in a follower body. To prevent lateral motion of the shaft, it is selectively hardened to maintain the ends soft enough to be deformed by a riveting tool which locks the shaft in position in the follower body shaft bores. The method not only requires selective hardening of the roller shaft but occasionally causes deformation of the follower body, requiring a finished part to be scrapped.

SUMMARY OF THE INVENTION

The present invention provides improved means and methods for retaining a roller cam follower shaft against lateral motion in a body without requiring selective hardening or being subject to deformation of the body during manufacturing. This is accomplished by providing retainer means which are pressed onto the shaft within a roller receiving recess of the follower body and are operatively engageable with the shaft supporting sides of the body so as to lock the roller shaft in its lateral position. The various embodiments of roller shaft retaining means disclosed may be applicable to various forms of roller cam followers including, for example; roller valve lifters, roller finger followers and roller rocker arms.

In a first embodiment, the invention provides a sleeve in the form of an inner bearing race for needle roller bearings supporting the follower roller. The sleeve or inner race is assembled with the roller and its bearing and the assembly is inserted into the roller pocket of the follower. The bearing shaft is then inserted through shaft bores in the sides of the follower body into a press fit relation with the sleeve. The sleeve engages or is engageable with the sides of the follower adjacent the shaft bores so as to limit or prevent axial motion of the shaft within the bores. If desired, the shaft is fitted loosely within the bores so that it may rotate in the shaft bores as a journal bearing for increasing durability of the combined bearing assemblies for the roller.

In a second embodiment, a sleeve may be provided with an integral flange at one end and a second flange assembled onto the other end after assembly of the sleeve with a roller and its associated needle bearings. The flanged sleeve acts as a spool, retaining the needle bearings in position during shipping or processing prior to assembly of the roller into a follower body. Upon assembly, the roller bearing shaft is again pressed into the sleeve and the flanges of the sleeve engage the sides of the follower body to limit axial motion of the shaft within the body as before.

In either embodiment, one end of the sleeve may have its inner diameter expanded by tapering or outward curvature to assist in assembling the shaft into the sleeve. Alternatively, one end of the shaft could have a tapered or curved outer diameter to assist in assembly.

In a third embodiment, the retaining means may comprise a pair of washers which are press fitted onto the shaft on either side of the roller and are engageable with the sides of the follower body to limit axial motion of the shaft within the body. As a variation, the shaft could be restrained by press fitting only one of the washers on the shaft and the other washer could be fitted loosely or entirely omitted. However this alternative would require the single washer interface with the shaft to absorb all thrust forces on the shaft.

In the latter embodiments using washers alone for restraint, the roller needle bearings would run directly on the shaft so that any cocking of the bearings during operation would apply thrust forces to the shaft to be restrained by the washers. In the cases where sleeves are pressed on the shaft and act as inner races for the needle bearings, any side forces caused by the needle bearings are applied directly to the sleeves and absorbed by the sides of the lifter without acting upon the shaft itself.

These and other features and advantages of the invention will be more fully understood from the following description of certain specific embodiments of the invention taken together with the accompanying drawings.

DESCRIPTION OF THE PREFERRED EMBODIMENT

Figure 1:
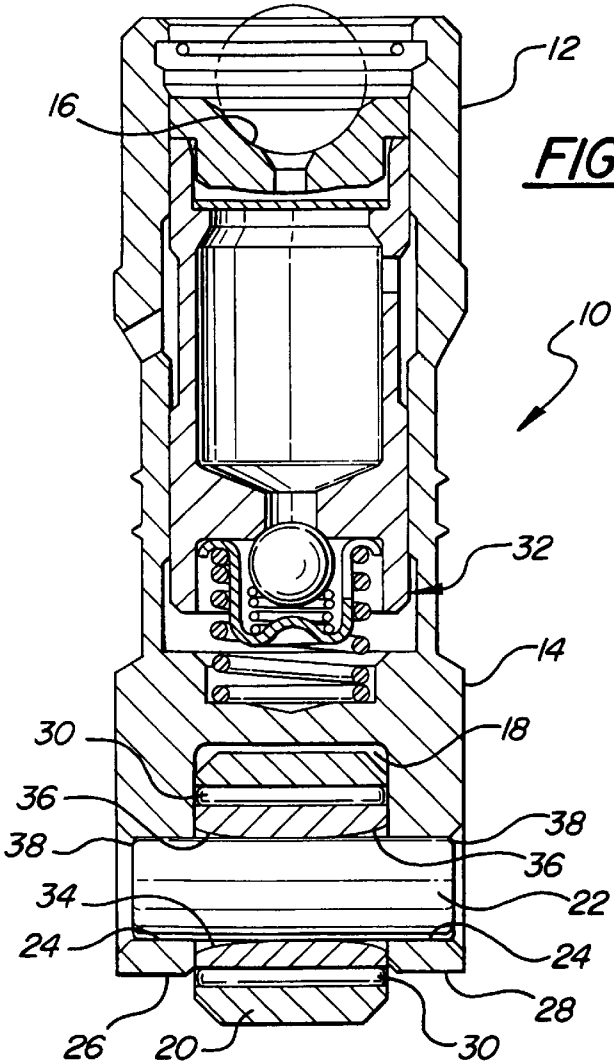
FIG. 1 is a cross-sectional view of a roller hydraulic valve lifter illustrating an application to a roller hydraulic valve lifter of a first embodiment of the invention having a pressed in sleeve as an inner bearing race.

Referring first to FIG. 1 of the drawings, numeral 10 generally indicates a roller hydraulic valve lifter formed according to the invention. Valve lifter 10 conventionally includes first and second ends 12, 14, respectively, each having generally cylindrical portions engageable with a bore of an engine valve lifter gallery, not shown. The first end 12 carries a seat 16 which is engaged by a push rod, not shown, for actuating an engine valve. The second end 14 defines a pocket or recess 18 in which a follower roller 20 is received. The roller 20 is supported on a transverse shaft 22 carried in laterally spaced shaft bores 24 formed in opposite sides 26, 28 of the body. The roller 20 is conventionally supported by needle roller bearings 30, although plain journal bearings could be used if desired. The interior of the body contains hydraulic lash adjusting means 32, the operation of which is well known and will not be further described.

In accordance with the invention, the roller 20 is supported on a sleeve 34 which forms an inner race for the roller bearings 30. The sleeve 34 is press fitted onto the shaft 22 and extends laterally into engagement with or close opposition to the opposite sides 26, 28 of the lifter body. Thus, axial motion of the shaft 22 within the shaft bores 24 is limited by engagement of the sleeve 34 with the sides 26, 28. The roller 20 and roller bearings 30 are free to rotate within the recess 18 around the outer diameter of the sleeve 34. At either end of the sleeve, the inner diameter has short outwardly tapered portions 36 and the edges 38 of the ends of shaft 22 are rounded.

To assemble the (second) roller end 14 of the lifter, the roller 20 and roller bearings 30 are first assembled onto to the sleeve 34 to make a roller bearing assembly that is inserted into the recess 18. The shaft 22 is then inserted through one of the shaft bores 24 and pressed into the inner diameter of the sleeve 34 so that the sleeve is held tightly onto the shaft and prevents its lateral motion. The curved edges 38 of the shaft and the tapered portions 36 of the sleeve inner diameter combine to assist in aligning the sleeve with the shaft during assembly.

In operation, any lateral loads generated by the action of the roller bearings are transmitted by the sleeve directly to the sides 24 of the lifter body and so are not applied to the shaft 22. Axial loads in the direction of the lifter axis are transmitted from the roller to the shaft and from the shaft through the shaft bores 24 to the lifter body. While the shaft may, if desired, be press fitted in the shaft bores 24, it is presently preferred to provide a suitable bearing clearance between the shaft 22 and bores 24 so that the shaft may freely rotate therein and reduce the rolling wear on the roller and its bearings.

Figure 2:
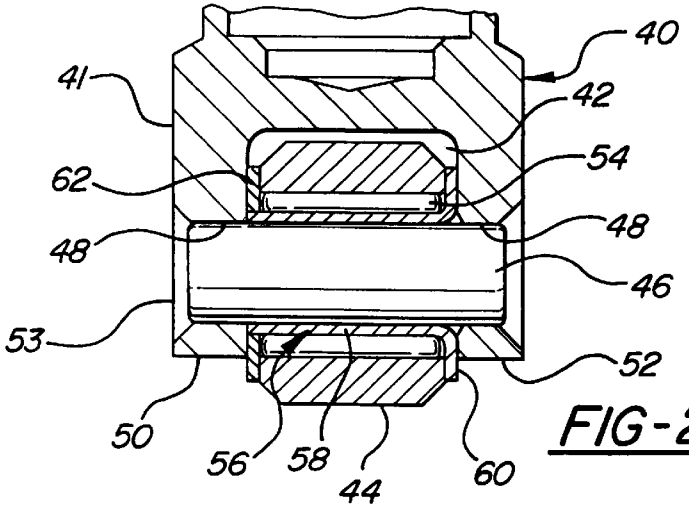
FIG. 2 is a cross-sectional view of the lower portion of a valve lifter similar to FIG. 1 but illustrating an application of a second embodiment using a flanged sleeve.

Referring now to FIG. 2 of the drawings, numeral 40 generally indicates an alternative embodiment of valve lifter. Only the lower end 41 of lifter 40 is shown as the upper portions are similar to the lifter 10 previously described. Lifter 40 also includes a recess 42 in the lower end 41 in which a follower roller 44 is received. The roller 44 is supported on a shaft 46 carried in shaft bores 48 formed in spaced sides 50, 52 of the body. The roller is supported on needle roller bearings 54 which are carried on the outer diameter of a sleeve 56. The sleeve 56 has a cylindrical central portion 58 extending for a length slightly greater than that of the roller bearings 54. At one end, the sleeve 56 has an integral flange 60 while a second flange 62 is fixed to the other end of the sleeve by staking or any other suitable manner.

To assemble the (lower) roller end of the lifter, the roller 44 and roller bearings 54 are first assembled onto the sleeve 56 prior to assembly of the second flange 62. Thereafter the flange 62 is staked in place on the end of the sleeve opposite from the integral flange 60 so that the roller 44 and accompanying roller bearings 54 are retained in an assembly with the sleeve 56 which, when assembled, has the form of a spool. The roller and sleeve assembly may then be handled, shipped or otherwise processed prior to assembly into the lifter without any of the roller bearings being lost from the assembly.

To assemble the lifter, the roller and sleeve assembly is first installed into the recess 42 and then the shaft 46 is inserted through the shaft bores 48 and into press fit engagement with the inner diameter of the sleeve 56. As installed, the flanges 60, 62 lie in engagement with or close opposition to the sides 50, 52 of the lifter body and thus limit lateral motion of the shaft 46 within the shaft bores 48. As before, the shaft may be loosely fitted in the shaft bores so that it may rotate therein and reduce wear on the roller bearing assembly.

Figure 3:
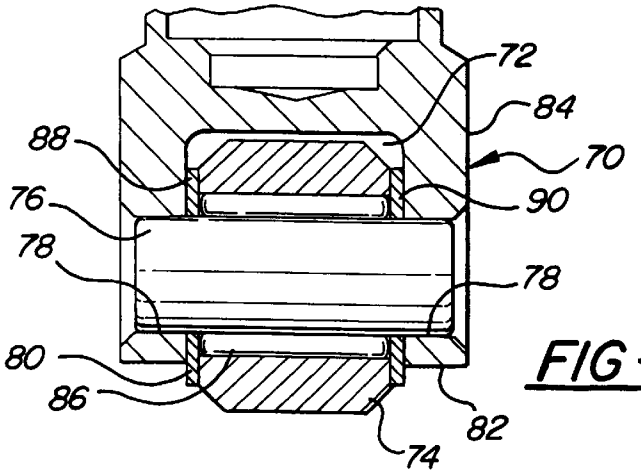
FIG. 3 is a cross-sectional view similar to FIG. 2 but showing an application of a third embodiment of the invention using pressed on washers to restrain the lifter bearing shaft.

Referring now to FIG. 3 of the drawings, numeral 70 generally indicates a roller hydraulic valve lifter, only the lower end of which is shown as the other portions are similar to that of the lifter first described. Valve lifter 70 includes a pocket or recess 72 in which a follower roller 74 is supported on a shaft 76 carried in shaft bores 78 formed in opposite sides 80, 82 of the lifter body 84. In the present instance, the roller is carried by needle roller bearings 86 directly on the outer diameter of the shaft 76.

Each side of the roller 74 is engageable with shaft retainers in the form of thrust washers 88, 90 which are press fitted onto the outer diameter of the shaft 76. The thrust washers are disposed in engagement with or close opposition to the sides 80, 82 of the body and thus limit axial motion of the shaft 76 within the shaft bores 78. Lateral clearance is provided between the washers 88, 90 and the roller 70 and bearings 86 so that free rotation of the roller and bearings is permitted. Also the shaft 76 may be loosely fitted in the bores 78 so that rotation of the shaft therein is also permitted and wear is shared between the bearings and shaft journals.

To assemble the lifter (lower) roller end, the roller and its accompanying roller bearings 86 are first inserted into the recess 72, a plug being fitted within the roller to hold the roller bearings in place. At this time the thrust washers 88, 90 are also inserted into the recess 72 on either side of the roller, or they could be inserted together with the roller and roller bearing assembly. Thereafter, the shaft 76 is inserted through the shaft bores 78 and into press fit engagement with the washers 88, 90, forcing the plug out from the roller bearings so that the bearings 86 are supported directly on the shaft 76 as shown. Thereafter, the press fit of washers 88, 90 on the shaft restrains the shaft against substantial lateral motion in the bores 78.

It should be noted that it would be possible, if desired, to provide only one of the two thrust washers with a press fit on the shaft 76, leaving the other thrust washer loose on the shaft or omitting it entirely. In either case, the single thrust washer could prevent lateral motion of the shaft within the bores 78 as long as excessive stress was not developed due to the use of the single washer.

Figure 4:
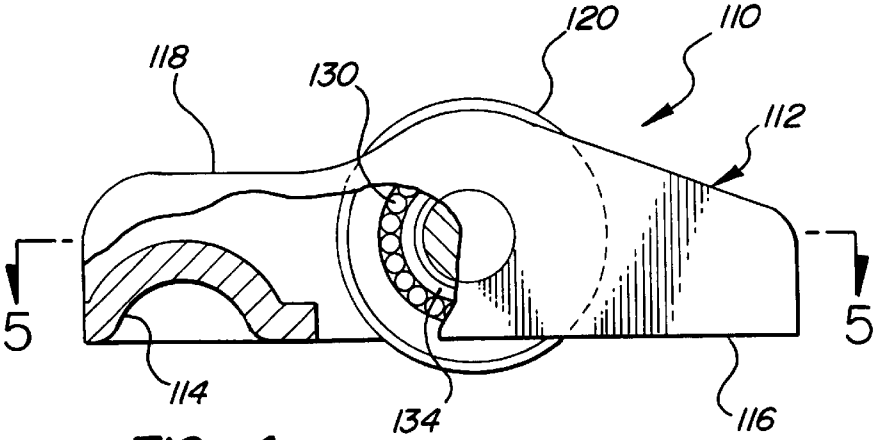
FIG. 4 is a side view of a roller finger follower partially broken away to illustrate an alternate application to a roller finger follower of the first embodiment of the invention.
Figure 5:
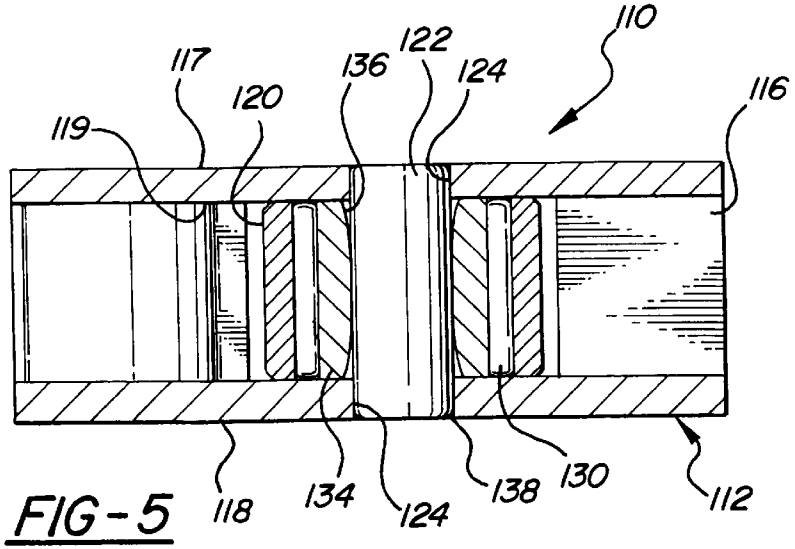
FIG. 5 is a cross-sectional view from the line 5—5 of FIG. 4.

Referring now to FIGS. 4 and 5, numeral 110 generally indicates a roller finger follower for use in engine valve gear and incorporating features of the first embodiment of the invention illustrated in FIG. 1. Finger follower 110 includes a channel shaped body 112 formed with a pivot recess 114 at one end and an actuating pad 116 at the other end. Recess 114 is engageable with a pivot or the plunger of a stationary hydraulic lash adjuster in an engine cylinder head, not shown. Pad 116 is engageable with a valve stem, not shown, for opening the valve when the follower 110 is actuated.

The follower body includes sides 117, 118 which centrally define a pocket or recess 119 in which a cam follower roller 120 is received. The roller 120 is supported on a transverse shaft 122 carried in laterally spaced bores 124 formed on the opposite sides 118, 119 of the follower body. The roller is conventionally supported by needle roller bearings 130, although plain journal bearings could be used if desired.

In accordance with the first embodiment of the invention (as shown in FIG. 1) the roller 120 is supported on a sleeve 134 which forms an inner race for the roller bearings 130. The sleeve 134 is press fitted onto the shaft 122 and extends laterally into engagement with or close opposition to the opposite sides 118, 119 of the follower body. Thus, axial motion of the shaft 122 within the shaft bores 124 is limited by engagement of the sleeve 134 with the sides 118, 119. The roller 120 and roller bearings 130 are free to rotate in the recess between the sides 118, 119 around the outer diameter of the sleeve 134. At either end of the sleeve, the inner diameter has short outwardly tapered portions 136 and the edges 138 of the ends of shaft 122 are rounded.

To assemble the roller to the follower body 112, the roller 120 and roller bearings 130 are first assembled onto to the sleeve 134 to make a roller bearing assembly that is inserted into the recess between sides 118, 119. The shaft 122 is then inserted through one of the shaft bores 124 and pressed into the inner diameter of the sleeve 134 so that the sleeve is held tightly onto the shaft and prevents its lateral motion. The curved edges 138 of the shaft and the tapered portions 136 of the sleeve inner diameter combine to assist in aligning the sleeve with the shaft during assembly.

In operation, as in the embodiment of FIG. 1, any lateral loads generated by the action of the roller bearings 130 are transmitted by the sleeve 134 directly to the sides 118, 119 of the follower body and so are not applied to the shaft 122. Valve actuating loads normal to the direction of the shaft 122 are transmitted from the roller to the shaft and from the shaft through the shaft bores 118, 119 to the follower body. While the shaft may, if desired, be press fitted in the shaft bores 24, it would be possible to provide a suitable bearing clearance between the shaft 122 and bores 118, 119 so that the shaft may freely rotate therein and reduce the rolling wear on the roller and its bearings.

Figure 6:
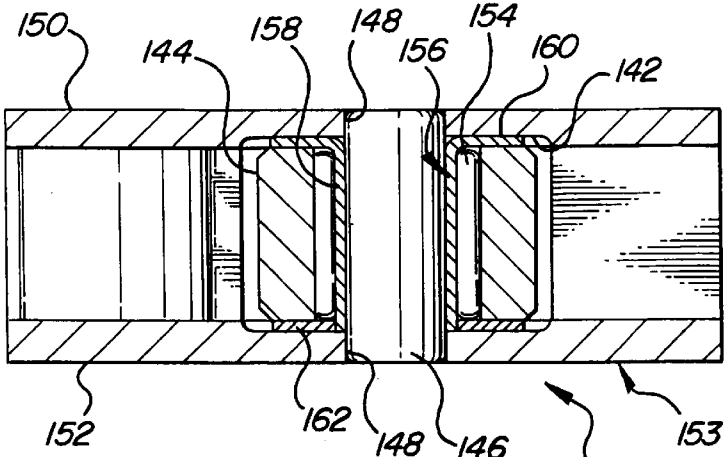
FIG. 6 is a view similar to FIG. 5 but showing an alternate application of the second embodiment of the invention.

Referring now to FIG. 6 of the drawings, numeral 140 generally indicates an alternative embodiment of roller finger follower which is generally similar to the follower 110 previously described. Follower 140 also includes a recess 142 in which a follower roller 144 is received. The roller 144 is supported on a shaft 146 carried in shaft bores 148 formed in spaced sides 150, 152 of the body 153. The roller is supported on needle roller bearings 154 which are carried on the outer diameter of a sleeve 156. The sleeve 156 has a cylindrical central portion 158 extending for a length slightly greater than that of the roller bearings 154. At one end, the sleeve 156 has an integral flange 160 while a second flange 162 is fixed to the other end of the sleeve by staking or any other suitable manner.

To assemble the roller assembly, the roller 144 and roller bearings 154 are first assembled onto the sleeve 156 prior to assembly of the second flange 162. Thereafter the flange 162 is staked in place on the end of the sleeve opposite from the integral flange 160 so that the roller 144 and accompanying roller bearings 154 are retained in an assembly with the sleeve 156 which, when assembled, has the form of a spool. The roller and sleeve assembly may then be handled, shipped or otherwise processed prior to assembly into the follower without any of the roller bearings being lost from the assembly.

To assemble the follower, the roller and sleeve assembly is first installed into the recess 142 and then the shaft 146 is inserted through the shaft bores 148 and into press fit engagement with the inner diameter of the sleeve 156. As installed, the flanges 160, 162 lie in engagement with or close opposition to the sides 150, 152 of the follower body and thus limit lateral motion of the shaft 146 within the shaft bores 148. As before, the shaft may be loosely fitted in the shaft bores so that it may rotate therein and reduce wear on the roller bearing assembly.

Figure 7:
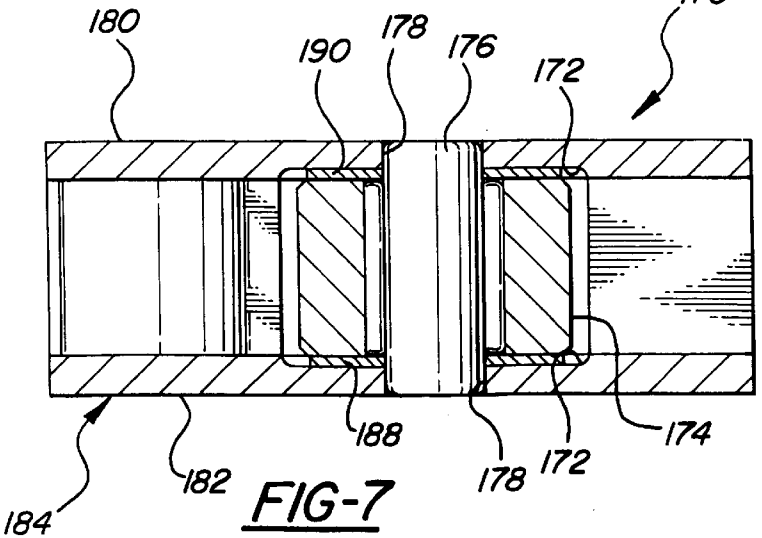
FIG. 7 is a view similar to FIG. 6 but showing an alternate application of the third embodiment of the invention.

Referring now to FIG. 7 of the drawings, numeral 170 generally indicates another finger follower which is generally similar to that of the follower 110. Follower 170 also includes a pocket or recess 172 in which a follower roller 174 is supported on a shaft 176 carried in shaft bores 178 formed in opposite sides 180, 182 of the follower body 184. In the present instance, the roller is carried by needle roller bearings 186 directly on the outer diameter of the shaft 176.

Each side of the roller 174 is engageable with shaft retainers in the form of thrust washers 188, 190 which are press fitted onto the outer diameter of the shaft 176. The thrust washers are disposed in engagement with or close opposition to the sides 180, 182 of the body and thus limit axial motion of the shaft 176 within the shaft bores 178. Lateral clearance is provided between the washers 188, 190 and the roller 174 and bearings 186 so that free rotation of the roller and bearings is permitted. Also, the shaft 176 may be loosely fitted in the bores 178 so that rotation of the shaft therein is also permitted and wear is shared between the bearings and shaft journals.

To assemble the follower, the roller and its accompanying roller bearings 186 are first inserted into the recess between sides 180, 182, a plug, not shown, being fitted within the roller to hold the roller bearings in place. At this time the thrust washers 188, 190 are also inserted into the recess on either side of the roller, or they could be inserted together with the roller and roller bearing assembly. Thereafter, the shaft 176 is inserted through the shaft bores 178 and into press fit engagement with the washers 188, 190, forcing the plug out from the roller bearings so that the bearings 186 are supported directly on the shaft 176 as shown. Thereafter, the press fit of washers 188, 190 on the shaft restrains the shaft against substantial lateral motion in the bores 178.

It should be noted that it would be possible, if desired, to provide only one of the two thrust washers with a press fit on the shaft 176, leaving the other thrust washer loose on the shaft or omitting it entirely. In either case, the single thrust washer could prevent lateral motion of the shaft within the bores 178 as long as excessive stress was not developed due to the use of a single washer.

In the same manner as disclosed above for roller valve lifters and roller finger followers, the various embodiments of the invention could be applied to other cam follower devices, such as for example, roller rocker arms. Therefore, while the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. An engine cam follower having a body with a cam follower roller rotatably mounted in a recess between opposite sides of the body on a transverse shaft supported in shafts bores through the sides, characterized by:

retainer means pressed onto the shaft within said recess and operatively engageable with said sides of the body to limit axial motion of the shaft in said shaft bores.

2. An engine cam follower as in claim 1 wherein said retainer means is a sleeve having opposite ends operatively engageable with said sides of the body to limit axial motion of the shaft.

3. An engine cam follower as in claim 2 wherein said sleeve acts as an inner race for supporting rotation of said roller on said shaft.

4. An engine cam follower as in claim 3 wherein said roller is supported by roller bearings on said inner race.

5. An engine cam follower as in claim 4 wherein said sleeve includes flanges at opposite ends of the sleeve and operative after assembly with the roller to retain said roller bearings within the roller prior to installation of the roller and sleeve assembly into said lifter body.

6. An engine cam follower as in claim 5 wherein one of said flanges is formed integral with said sleeve and the other of said flanges is fixed to the sleeve after assembly of the sleeve with the roller.

7. An engine cam follower as in claim 2 wherein said sleeve includes an inner diameter for engagement with said shaft, said inner diameter being enlarged adjacent at least one end of the sleeve to facilitate installation of the shaft into the sleeve.

8. An engine cam follower as in claim 2 wherein said shaft includes an outer diameter for engagement with said sleeve, said outer diameter being reduced adjacent at least one end of the shaft to facilitate installation of the shaft into the sleeve.

9. An engine cam follower as in claim 1 wherein said retainer means is at least one washer pressed onto the shaft adjacent to the roller within said recess and operatively engageable with at least one side of the body and the roller to limit axial motion of the shaft in said shaft bores.

10. An engine cam follower as in claim 9 including a pair of said washers, one adjacent each side of the body and operatively engageable therewith to limit axial motion of the shaft.

11. An engine cam follower as in claim 10 wherein said shaft includes an outer diameter for engagement with said washers, said outer diameter being reduced adjacent at least one end of the shaft to facilitate installation of the shaft into the washers.

12. An engine cam follower as in claim 1 wherein said cam follower is a roller valve lifter.

13. An engine cam follower as in claim 1 wherein said cam follower is a roller finger follower.

* * * * *